US011753291B2

(12) United States Patent
Cunneen

(10) Patent No.: US 11,753,291 B2
(45) Date of Patent: Sep. 12, 2023

(54) SYSTEM AND METHOD OF TRANSPORTING BEVERAGE

(71) Applicant: Island Clan, LLC, Southborough, MA (US)

(72) Inventor: Bruce Cunneen, Wayland, MA (US)

(73) Assignee: Island Clan, LLC, Southborough, MA (US)

( * ) Notice: Subject to any disclaimer, the term of this patent is extended or adjusted under 35 U.S.C. 154(b) by 0 days.

(21) Appl. No.: 17/317,247

(22) Filed: May 11, 2021

(65) Prior Publication Data

US 2021/0347626 A1 Nov. 11, 2021

Related U.S. Application Data

(60) Provisional application No. 63/023,238, filed on May 11, 2020.

(51) Int. Cl.

| | |
|---|---|
| ***B67D 1/07*** | (2006.01) |
| ***B67D 1/04*** | (2006.01) |
| ***B67D 1/00*** | (2006.01) |
| ***B67D 1/12*** | (2006.01) |
| ***B67D 1/08*** | (2006.01) |

(52) U.S. Cl.

CPC ..... *B67D 1/07* (2013.01); *B67D 1/0085* (2013.01); *B67D 1/04* (2013.01); *B67D 1/0888* (2013.01); *B67D 1/1243* (2013.01); *B67D 1/0468* (2013.01); *B67D 2001/0093* (2013.01)

(58) Field of Classification Search

CPC .. B67D 1/0406; B67D 1/0834; B67D 1/0837; B67D 1/07; B67D 1/0085; B67D 1/04; B67D 1/0888; B67D 2001/0093; B08B 9/0321–0325; B08B 9/0328; B08B 9/032; B08B 2209/02; B08B 2209/027; B08B 2209/032; A47J 31/46–461; A47J 31/60

See application file for complete search history.

(56) References Cited

U.S. PATENT DOCUMENTS 1,963,784 A * 6/1934 Freund ..... D01H 7/62 137/207.5
2,022,951 A * 12/1935 Cohen ..... B67D 1/07 137/207.5
2,030,398 A * 2/1936 Rivard ..... B67D 1/07 137/239
2,039,006 A * 4/1936 Jasper ..... B08B 9/0323 137/207.5

(Continued)

*Primary Examiner* — Paul R Durand
*Assistant Examiner* — Randall A Gruby
(74) *Attorney, Agent, or Firm* — Nixon Peabody LLP

(57) ABSTRACT

A system for transporting beverage includes a container, an output port, a first length of tubing, a first gas source, and a valve. The container has a volume of beverage disposed therein. The first length of tubing has a first end and a second end. The first end of the first length of tubing is fluidly coupled to the container. The second end of the first length of tubing is fluidly coupled to the output port. The first gas source is fluidly coupled to the container via a second length of tubing. The second gas source is fluidly coupled to the first length of tubing. The valve has at least a first port and a second port. The first port of the valve is fluidly coupled to the first length of tubing. The second port is fluidly coupled to a clearing fluid source.

9 Claims, 6 Drawing Sheets

(56) References Cited

U.S. PATENT DOCUMENTS 2,092,257 A * 9/1937 Lewis ..... B08B 9/0323 137/239
2,098,525 A * 11/1937 Smith ..... B08B 9/0326 137/207.5
2,109,896 A * 3/1938 Anderson ..... B67D 1/07 137/207.5
2,167,309 A * 7/1939 Norton ..... B67D 1/04 62/246
2,175,951 A * 10/1939 Bulleri ..... B08B 9/0323 137/239
2,178,559 A * 11/1939 Coben ..... B08B 9/0323 137/597
2,194,681 A * 3/1940 Wheler ..... B08B 9/0323 137/207.5
2,196,176 A * 4/1940 Brigham ..... B08B 9/0321 137/239
2,237,014 A * 4/1941 Stoehrer ..... B08B 9/0321 222/145.2
2,263,922 A * 11/1941 Guttman ..... B08B 9/0321 134/102.1
2,331,460 A * 10/1943 Davis ..... B08B 9/057 137/239
2,371,188 A * 3/1945 Russell ..... B08B 9/0323 137/207.5
2,443,550 A * 6/1948 Zwosta ..... B67D 1/07 222/399
2,458,230 A * 1/1949 Warcup ..... B08B 9/0323 137/238
2,591,985 A * 4/1952 Warcup ..... B08B 9/0323 137/212
2,619,119 A * 11/1952 Warcup ..... B67D 1/07 137/212
2,774,229 A * 12/1956 Thau ..... B67D 1/06 62/395
2,777,452 A * 1/1957 Zwosta ..... B08B 9/0323 134/102.1
2,827,070 A * 3/1958 Gatz ..... B08B 9/057 137/239
2,917,906 A * 12/1959 Woolley ..... F25D 31/006 62/457.2
3,115,150 A * 12/1963 Sariotti ..... B67D 1/0835 137/625.46
3,120,326 A * 2/1964 Hedeman ..... B67D 1/07 222/145.2
3,830,248 A * 8/1974 Brown ..... B08B 9/032 134/198
4,088,245 A * 5/1978 Brown ..... B01J 4/008 134/103.2
4,572,230 A * 2/1986 Mirabile ..... B67D 1/07 222/400.7
4,955,100 A * 9/1990 Bersch ..... B08B 9/057 137/625.48
5,072,476 A * 12/1991 Bersch ..... B08B 9/057 15/104.063
5,564,602 A * 10/1996 Cleland ..... F28D 7/0016 222/399
5,601,101 A * 2/1997 Grapes ..... B08B 9/0325 134/100.1
5,762,096 A * 6/1998 Mirabile ..... B08B 9/0325 134/169 C
6,240,952 B1 * 6/2001 Schroeder ..... B67D 1/07 134/169 R
6,446,659 B2 * 9/2002 Schroeder ..... B67D 1/108 134/169 R
7,757,908 B1 * 7/2010 Buhl, Jr. ..... B67D 1/06 62/239
8,887,961 B2 * 11/2014 Bax ..... B67D 1/07 15/104.062
9,073,741 B2 * 7/2015 Jannatkhah ..... B67D 1/0004
10,280,059 B2 * 5/2019 Peirsman ..... B67D 1/0857
10,392,238 B2 * 8/2019 Lawler ..... B67D 1/07
10,464,799 B2 * 11/2019 Carson ..... B08B 9/0321
10,815,115 B2 * 10/2020 Pickett ..... B08B 9/0325
2003/0183249 A1 * 10/2003 Nissinen ..... B67D 1/07 134/169 C
2004/0245281 A1 * 12/2004 Oke ..... B08B 9/08 222/1
2007/0245766 A1 * 10/2007 Younkle ..... F28D 1/06 62/393
2008/0223410 A1 * 9/2008 Molloy ..... B08B 9/0325 134/113
2011/0114680 A1 * 5/2011 Haskayne ..... B67D 1/0868 222/400.7
2018/0362319 A1 * 12/2018 Park ..... B67D 1/07
2020/0247657 A1 * 8/2020 Christiansen ..... B67D 1/0888
2021/0347626 A1 * 11/2021 Cunneen ..... B67D 1/0888

* cited by examiner

SYSTEM AND METHOD OF TRANSPORTING BEVERAGE

CROSS-REFERENCE TO RELATED APPLICATIONS

This application claims the benefit of, and priority to, U.S. Provisional Patent Application No. 63/023,238 filed May 11, 2020, which is hereby incorporated by reference herein in its entirety.

TECHNICAL FIELD

This disclosure relates to transporting liquids, and more specifically to transporting and dispensing beverages via a keg system.

BACKGROUND

During a routine draft beer pour, a keg housing the beer typically runs out ("kicks"), and the bartender or other user is forced to stop and wait for the keg to be changed before completing the pour. This wait can take a few minutes, or, if there is no more of that particular beer available, the pour may never be completed. There may also be additional costs associated with a brand change from beer A to beer B resulting from the keg kicking. The volume of beer trapped in the beer line varies per system. A typical rule of thumb is about ½ oz per foot of ⅜ ID beer line. A 30-foot beer line (which is quite short for the industry) has the equivalent of about one 16 oz beer in its line at all times. A hundred-foot line will have as much as three 16 oz beers.

Thus, a need exists for a beverage system that that eliminates the hassle of keg kicking. The present disclosure is directed to solving these problems and addressing other needs.

SUMMARY

According to some implementations of the present disclosure, a system for transporting beverage includes a container, an output port, a first length of tubing, a first gas source, and a valve. The container has a volume of beverage disposed therein. The first length of tubing has a first end and a second end. The first end of the first length of tubing is fluidly coupled to the container. The second end of the first length of tubing is fluidly coupled to the output port. The first gas source is fluidly coupled to the container via a second length of tubing. The second gas source is fluidly coupled to the first length of tubing. The valve has at least a first port and a second port. The first port of the valve is fluidly coupled to the first length of tubing. The second port is fluidly coupled to a clearing fluid source. The valve is operable between a first orientation and a second orientation. The first orientation fluidly connects the container and the output port via the first length of tubing. The second orientation fluidly connects the clearing fluid source and the output port via the first length of tubing.

According to some implementations of the present disclosure, a method of transporting beverage includes, responsive to a first input, a first gas source fluidly connected to the container causing a beverage to flow from a container through a length of tubing and out of an output port. Responsive to a second input, a clearing fluid source fluidly connected to the length of tubing causes the beverage to flow through the length of tubing and out of the output port.

The foregoing and additional aspects and implementations of the present disclosure will be apparent to those of ordinary skill in the art in view of the detailed description of various embodiments and/or implementations, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

Figure 1:
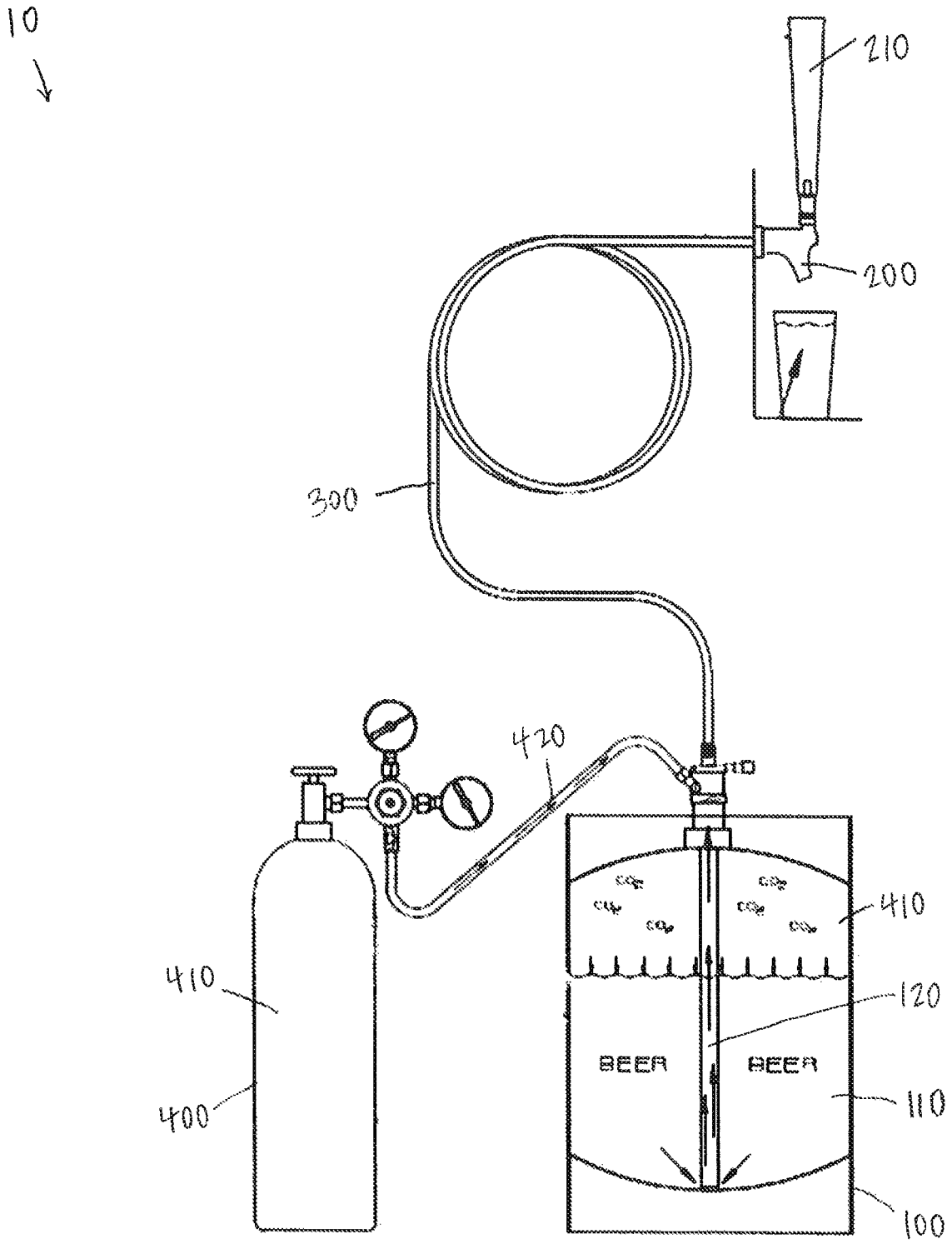
FIG. 1 illustrates a beverage transportation system that is capable of dispensing beverage from a beverage container.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the present disclosure as defined by the appended claims.

DETAILED DESCRIPTION

Referring generally to FIG. 1, a beverage system 10 includes a beverage container 100 (e.g., a keg), an output port 200, and a beverage line 300. The beverage line 300 is fluidly coupled to the beverage container 100 at a first end, and fluidly coupled to the output port 200 at a second end. The beverage container 100 has a volume of beverage 110 disposed therein. For example, the output port 200 can include a standard nozzle where the beverage 110 is dispensed from. In some implementations, the beverage 110 disposed in the beverage container 100 is draft beer. In some exemplary implementations, the beginning volume of the beverage 110 in the beverage container 100 is 15.5 gallons. More or less volume is also contemplated.

The beverage system 10 also includes a first gas source 400 that aids in forcing the beverage 110 into the beverage line 300 towards the output port 200. The first gas source 400 is fluidly coupled to the beverage container 100 via a first gas tube 420. In some exemplary implementations, the first gas source 400 is a cylinder containing pressurized gaseous substance 410 (e.g., carbon dioxide).

The beverage system 10 can include a tap handle 210 at the output port 200. When the tap handle 210 is activated (e.g., pulled forward), the first gas source 400 introduces the gaseous substance 410 into the beverage container 100 from the top. The gaseous substance 410 located above the beverage 110 in the beverage container 100 pushes a portion of the beverage 110 downward into an opening of a discharge tube 120. Once the portion of the beverage 110 enters the discharge tube 120, it travels upwards into the beverage line 300, headed for the output port 200 (e.g., an open tap).

When the tap handle 210 is deactivated (e.g., pushed backwards in the reverse direction), the first gas source 400 stops introducing the gaseous substance 410 into the beverage container, and therefore stops the flow of the beverage 110 to the output port.

Figure 2:
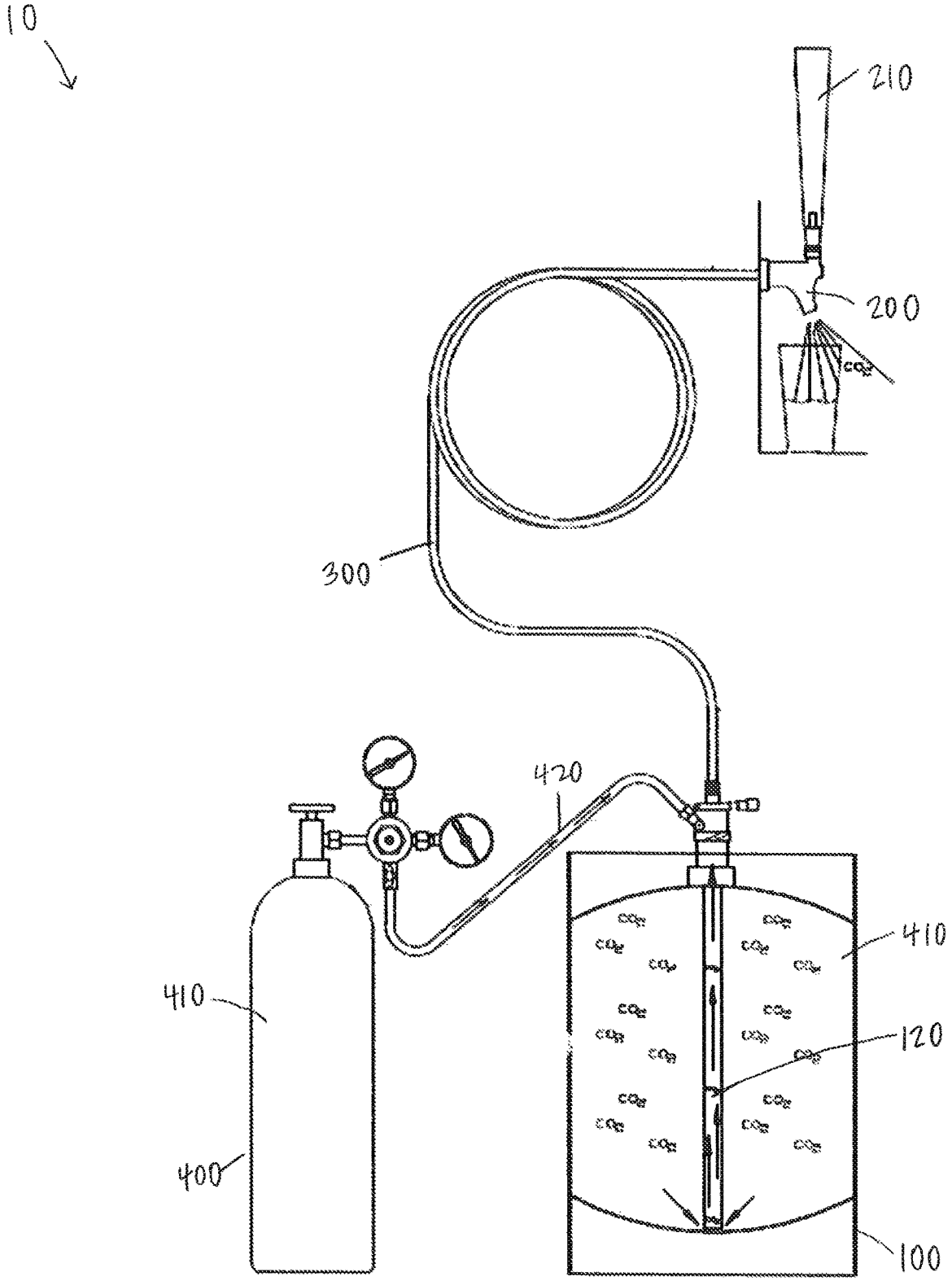
FIG. 2 illustrates the beverage transportation system of FIG. 1 when the beverage container runs out of beverage.

Referring now to FIG. 2, when the beverage container 100 runs out of the beverage 110, the beverage container 100 may "kick." Prior to the beverage container 100 running out of beer, when the tap handle 210 is pulled forward, the beverage 110 is caused to flow from the beverage container 100, through the beverage line 300, and out of the output port 200. When the keg kicks, the last of the beverage 110 in the beverage container 100 is forced into the discharge tube 120, and now the gaseous substance 410 is free to enter the discharge tube 120. Because a gaseous substance is often lighter than a liquid substance, the gaseous substance 410 rapidly filters through the beverage 110 disposed in the discharge tube 120 and in the beverage line 300. The beverage 110 in the discharge tube 120 and in the beverage line 300 is no longer lifted by the gaseous substance 410 and, thus, begins to settle backward. In short order, the gaseous substance 410 reaches the output port 200 and forcefully expels the remaining amount of the beverage 110 in a geyser of foam. To replace the first beverage in the first beverage container 100 with a second beverage in a new beverage container 100 (which can be the same beverage or a different beverage) after the first beverage container kicks, a user of the beverage system 10 adds the new beverage container 100 and typically purges the remainder of the first beverage from the beverage system 10. As the first beverage is purged, it mixes with the second beverage. The user generally must run the system until the second beverage runs clearly. Thus, the user typically wastes a portion of the first beverage and a portion of the second beverage during the change.

Figure 3:
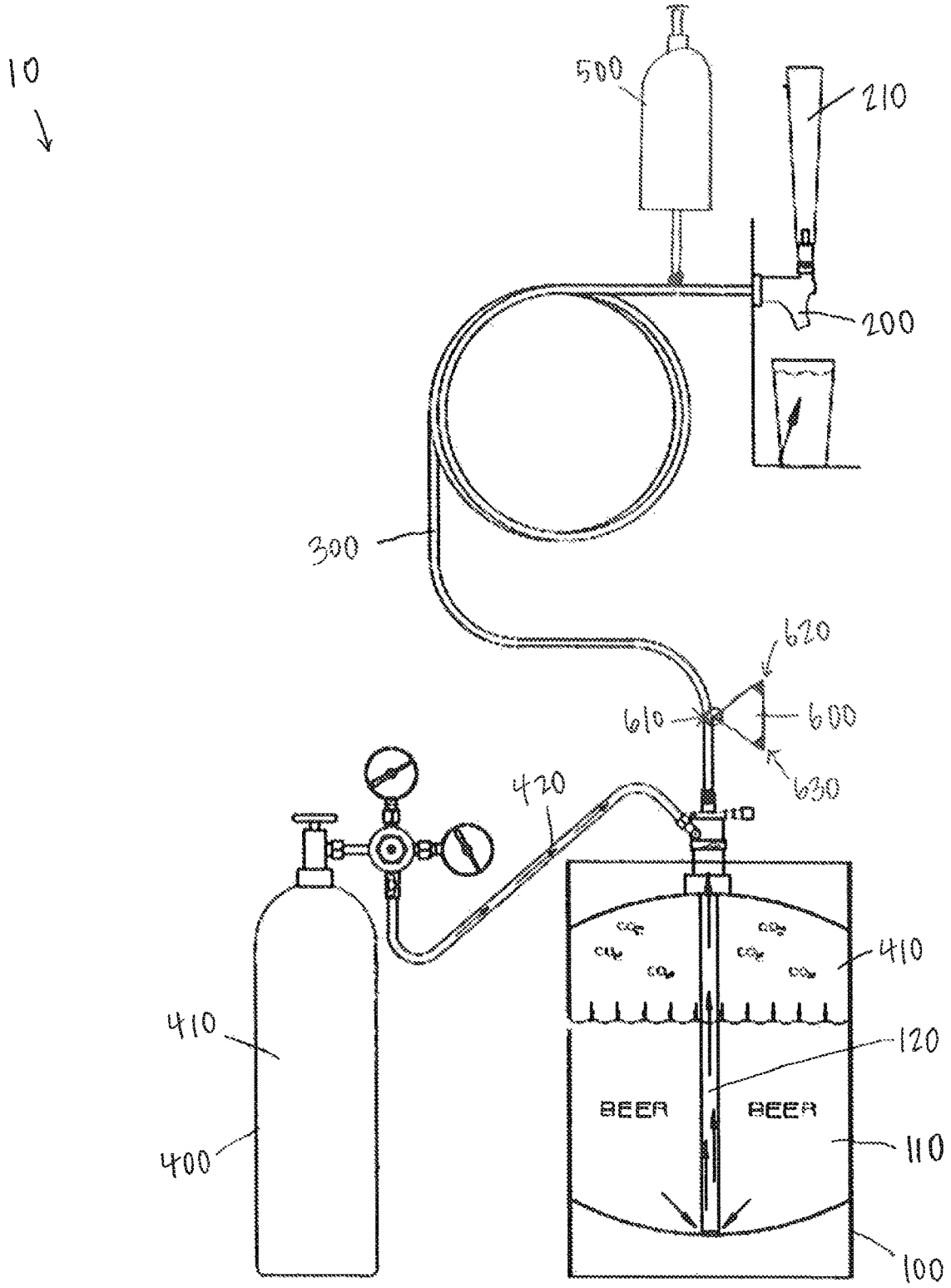
FIG. 3 illustrates the beverage transportation system including a valve system wherein the valve is at a first orientation.

Therefore, in some implementations and as best shown in FIG. 3, the beverage system 10 further includes a second gas source 500 and a valve 600. The second gas source 500 is fluidly coupled to the beverage line 300 between the beverage container 100 and the output port 200. In some implementations, the second gas source 500 is fluidly coupled to the beverage line 300 in close proximity to the output port 200, and the valve 600 is fluidly coupled to the beverage line 300 in close proximity to the beverage container 100. The valve 600 has at least a first port 610, a second port 620, and a third port 630. The first port 610 of the valve 600 is fluidly coupled to the beverage line 300. The second port 620 of the valve 600 is fluidly coupled to a clearing fluid source (e.g., a portable water connection). The third port 630 of the valve 600 is fluidly coupled to a waste reservoir 650 (see FIGS. 4 and 5). Thus, the valve 600 is a three-way valve that can connect the beverage line 300 to the beverage container 100, the clearing fluid source 640, or the waste reservoir 650.

In some implementations, the waste reservoir 650 is part of a standard waste drain system. In this implementation, the third port 630 can be coupled to a floor drain, for example a floor drain located in the floor of a kitchen, bathroom, laundry room, boiler room, or other suitable room. The third port 630 can be coupled to other types of drains as well, such as sink drains or shower drains. Thus, the beverage/clearing fluid mixture can be disposed of like any other type of waste water or other waste liquid in the establishment where the beverage system 10 is located. In these implementations or others, the third port 630 can be coupled to a drain, reservoir, or other structure using an air gap valve.

In some implementations, the beverage system 10 includes a mechanical switch or knob that causes the valve 600 to alternate orientations. In some implementations, the beverage system 10 includes one or more processing devices and one or more user input devices. The one or more processing devices and the one or more user input devices are used to control the system. The user input device is configured to receive input from the user regarding which beverage container needs replacement. The user can also indicate to the system the orientations of the valve 600 if needed.

The processing devices can be a laptop computer, a desktop computer, a tablet computing, a mobile phone, a personal digital assistant (PDA), a server, or any other suitable device. The user input device can generally be any of these devices as well, and may be the same or different from the processing device. In one example, a single computing device with a touch screen is both the processing device and the user input device. In another example, a single computing device with a keyboard and/or a mouse is both the processing device and the user input device. In yet another example, the processing device is one computing device (such as a laptop computer or a desktop computer), and the user input device is another computing device (such as a mobile telephone or a tablet computer. In still another example, the one or more processing devices that control the beverage system 10 include one or more programmable logic controllers (PLCs) that are customized to work with the beverage system 10. The one or more PLCs can be operatively connected to the valve 600 and can cause the valve 600 to move between orientations. The one or more PLCs can also be connected to the first gas source 400 and/or the second gas source 500 in order to control the flow of the gaseous substance from the first and second gas sources 400, 600, into the beverage line 300. Finally, in some implementations, the one or more PLCs can be configured to control the operation of the output port 200, for example via actuation of the tap handle 210. The one or more PLCs can control the operation of the output port 200 in other manners as well.

As best shown in FIG. 3, when there is still a portion of the beverage 110 disposed in the beverage container 100, the valve 600 is at a first orientation, and the beverage container 100 is fluidly connected to the output port 200 via the beverage line 300 and the first port 610 of the valve 600. The first gas source 400 is configured to cause at least a portion of the volume of beverage 110 disposed within the beverage container 100 to flow from the beverage container 100, through the beverage line 300, passing the first port 610 of the valve 600, and out of the output port 200, without interruption from the clearing fluid source or the second gas source 500.

Figure 4:
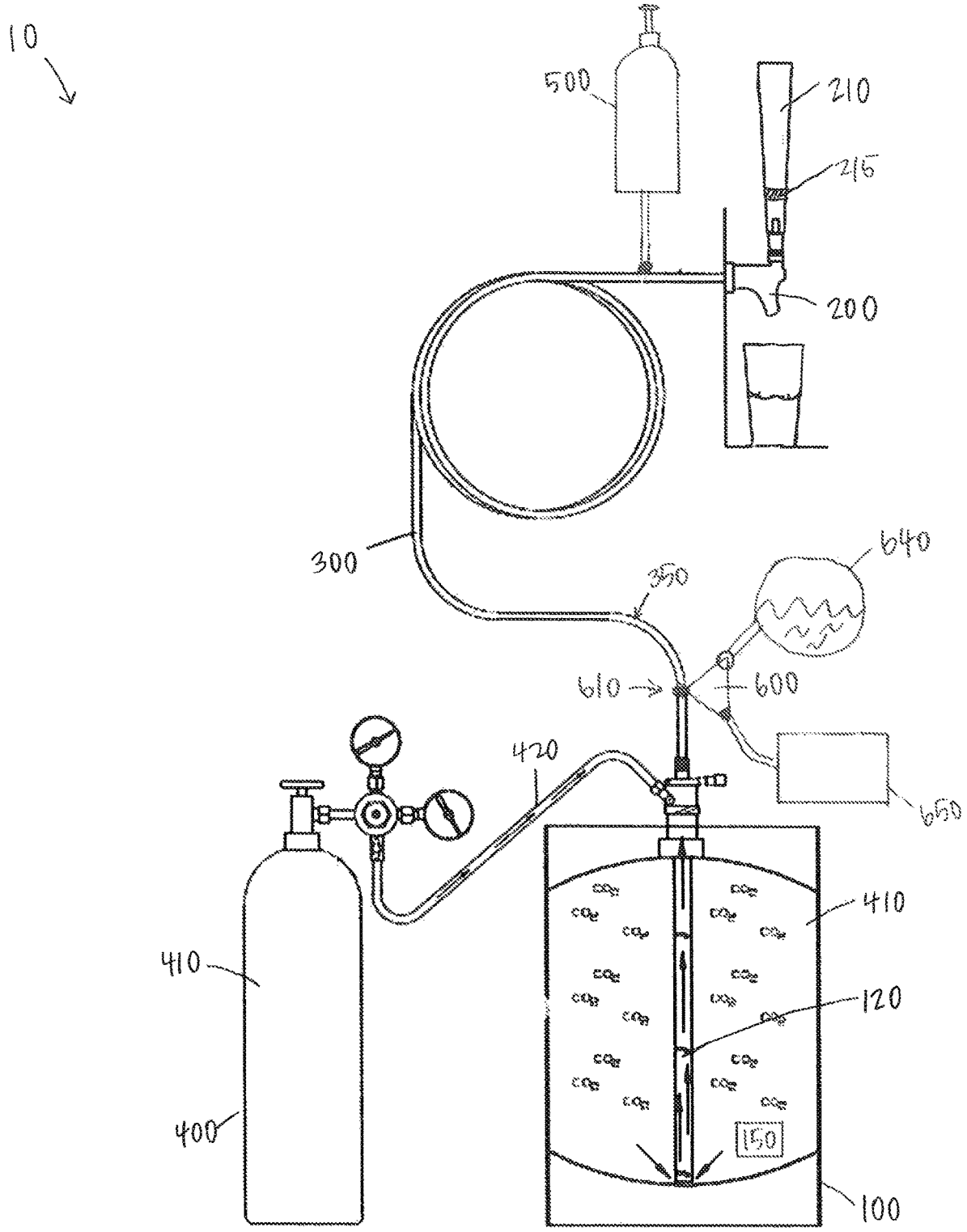
FIG. 4 illustrates the beverage transportation system of FIG. 3 wherein the valve is at a second orientation.

As best shown in FIG. 4, when the keg kicks, a user via the user input device may input a first signal that is indicative of the beverage container 100 being close to empty (i.e., an amount of beverage in the beverage container 100 that is equal to or less than a predetermined threshold). In response to the first signal, the one or more processors can be configured to cause the valve 600 to switch to a second orientation, such that the beverage container 100 can no longer supply beverage to the beverage line 300 because the first port 610 is now closed. In this second orientation, the clearing fluid source 640 is fluidly connected to the output port 200 via the beverage line 300 and the second port 620 of the valve 600. The clearing fluid source 640 is configured to cause a portion of the volume of beverage 110 that remains in the beverage line 300 to flow through the beverage line 300 and out of the output port 200. In some exemplary implementations, the clearing fluid is fresh water, and the clearing fluid source 640 supplies fresh water into the beverage line 300. The fresh water pushes the remaining beverage in the beverage line 300 toward the output port 200, allowing the user to complete filling an existing glass. The amount of remaining beverage to be displaced by the fresh water can be calculated based at least in part on the length of the beverage line 300, such that just enough fresh water pushes the remaining beverage toward the output port 200 without the fresh water itself reaching the output port 200. Depending on the length of the beverage line 300, the user may be able to fill three to four pints of beverage. It can be noted that while the valve 600 is at the second orientation, the beverage container 100 can be changed without interrupting service (e.g., filling a glass of beverage). Thus, the remainder of the first beverage can be served to customers, or can at least be purged without wasting any of the second beverage.

Figure 5:
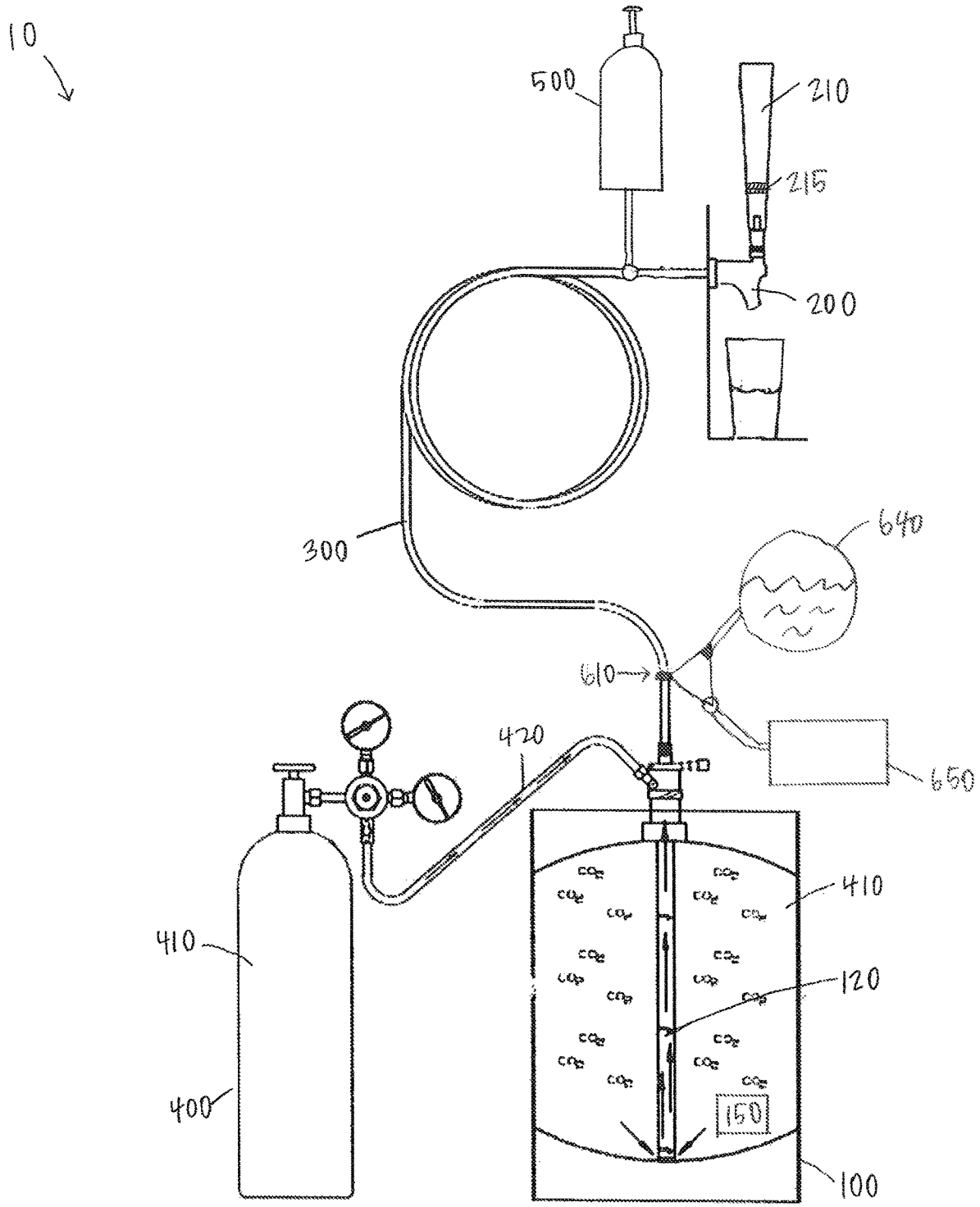
FIG. 5 illustrates the beverage transportation system of FIG. 3 wherein the valve is at a third orientation.

As best shown in FIG. 5, once a majority of the beverage is pushed out of the beverage line 300, the user via the user input device may input a second signal that is indicative of the beverage container 100 being close to displacing the remaining beverage in the beverage line 300 with fresh water (i.e., an amount of fresh water entering the beverage line 300 that exceeds a predetermined threshold associated with a volume capacity of the beverage line 300). In response to the second signal, the one or more processors can be configured to cause the valve 600 to switch to a third orientation. The clearing fluid source 640 can no longer supply water to the beverage line 300 because the second port is now closed. In this third orientation, the second gas source 500 is fluidly connected to the waste reservoir 650 via the beverage line 300 and the third port 630 of the valve 600. In some exemplary implementations, the second gas source 500 is a container of pressurized carbon dioxide, similar to or the same as the first gas source 400. When the valve 600 is switched to the third orientation, the second gas source 500 pushes gaseous substance through the beverage line 300, toward the valve 600, and eventually into the waste reservoir 650. The second gas source 500 is configured to cause the remaining beverage 110 and remaining water in the beverage line 300 to flow through the beverage line 300, passing the third port 630 of the valve 600, and into the waste reservoir 650, thereby cleaning at least the beverage line 300 between the second gas source 500 and the valve 600. Thus, any remaining beverage in the beverage line 300 (which is generally an amount too small to fill a glass) and the remainder of the clearing fluid can be disposed of along with any other waste water that may be generated and disposed of in the establishment. The clean beverage line 300 is then ready for the next beverage container, even if a change of beverage is initiated from a first beverage to a second beverage.

In summary regarding the valve orientations, when the valve 600 is in the first orientation, the beverage 110 flows out of the beverage container 100, through the beverage line 300, and out of the output port 200 (e.g., a nozzle). When the valve 600 is in the second orientation after the keg kicks, the beverage container 100 (e.g., keg) is interrupted from flowing beverage or water between the beverage container 100 and the output port 200 via the beverage line 300. The clearing fluid source 640 (e.g., water source) is connected instead, and the water can be forced through the beverage line 300 such that it forces the remaining beverage 110 in the beverage line 300 out of the output port 200. When the valve 600 is in the third orientation, the beverage line 300 is connected directly to the waste reservoir 650, and the second gas source 500 can be used to force the beverage/water mixture back down the beverage line 300 to the waste reservoir 650.

In response to the user input, the one or more processing devices are configured to cause the valve 600 to alternate between the first orientation, the second orientation, and the third orientation so that the remainder of the first beverage may be dispensed with the clearing fluid and the lines may be purged of the clearing fluid using the second gas source 500. In some exemplary implementations, the one or more processing devices include a micro-processor that is configured to sequence and protect events with delayed initiation, anti-tie down, and anti-repeat logic functions, thereby avoiding unintentional use. The beverage system 10 can be configured to automatically expel the remainder of the first beverage and purge the lines of the clearing fluid upon receiving input from the user indicating that the beverage container has kicked. In other implementations, the beverage system 10 changes the orientation of the valve 600 as needed, and awaits further input to initiate the dispensing of the remainder of the first beverage and the purging of the clearing fluid from the lines.

In some other implementations, the beverage system 10 is an automatic system where the valve 600 alternates its orientation without manual input. For example, instead of having a user input device, the beverage system may include one or more sensors that are configured to perform the same or similar functionalities as the user input device. In some such exemplary implementations, the beverage system 10 includes a first sensor 150 coupled to the beverage container 100 and a second sensor 350 coupled to the beverage line 300. The first sensor is configured to sense a volume of liquid in the beverage container 100 or an amount of gas in the beverage container 100. As more beverage is poured from the beverage container 100, the beverage container 100 is filled with more gas. Thus, to determine whether a volume of beverage has fallen below a threshold amount, the first sensor 150 can be configured to directly sense the volume of beverage, or to indirectly measure the volume of beverage by sensing the amount of gas. The second sensor is configured to sense a flow rate in the beverage line 300.

The beverage system 10 having sensors may have the valve defaulted to the first orientation, where the beverage 110 flows out of the beverage container 100, through the beverage line 300, and out of the output port 200 (e.g., a nozzle). When the first sensor 150 senses that the volume of beverage in the beverage container 100 is equal to or less than a predetermined threshold that is indicative of the beverage container 100 being close to empty, the one or more processors cause the valve 600 to switch to the second orientation. At the second orientation, fresh water from the clearing fluid source 640 forces the remaining beverage 110 in the beverage line 300 out of the output port 200. When the second sensor 350 senses that an amount of fresh water entering the beverage line 300 exceeds a predetermined threshold that is indicative of the beverage container 100 being close to displacing the remaining beverage in the beverage line 300 with fresh water (i.e., approximately equal to the volume capacity of the beverage line 300), the one or more processors cause the valve 600 to switch to the third orientation. At the third orientation, the beverage line 300 is connected directly to the waste reservoir 650, and the beverage/water mixture is forced back down the beverage line 300 to the waste reservoir 650.

Additionally or alternatively to the second sensor, the beverage system 10 may include a third sensor for determining when the liquid flowing past the third sensor changes from a first liquid (e.g., beer) to a second liquid (e.g., water). For example, the third sensor can be coupled to the beverage line 300 approximate the output port 200. Once the keg has kicked and water is pushed into the beverage line 300 to empty out the rest of the beverage from the beverage line 300, the third sensor is configured to determine when water (or a mixture of water and beverage) is flowing past the third sensor instead of the beverage alone. As such, the beverage system is configured to stop the pour.

Additionally or alternatively, the beverage system 10 may include an LED collar 215 near or at the tap handle 210. The LED collar 215 is configured to display a first color (e.g., red) that is indicative of the beverage container 100 being empty of beverage 110 and requiring changing. For example, the LED collar 215 is communicatively coupled to a volume sensor in the beverage container 100. When the volume sensor senses a volume of beverage in the beverage container 100 being equal to or less than a predetermined threshold indicative of the beverage container 100 being close to empty, the LED collar 215 is caused to display the first color. The beverage system 10 may further include a button or a switch. When pressed, the button or switch may cause the LED collar to display a second color (e.g., green) that is indicative of the keg change being completed and that the beverage container 100 has a sufficient amount of beverage therein.

As an example, when the keg kicks, the user of the beverage system 10 is given the option of continuing the pour via an input device at the tap handle 210 or switching and connecting to a new keg. If such an option to continue the pour is selected, drinking water can be introduced at a location closest to the keg into the beverage line 300, allowing the water to lift or push the remaining beverage contained in the beverage line 300 up to the output port 200 (e.g., the tap) such that the remaining beverage can be dispensed. A red LED light may illuminate, indicating water is being introduced into the line.

A more simplified beverage system is also contemplated. The simplified beverage system is the same as, or similar to, the beverage system 10 described above, except that the valve of the simplified beverage system only has a first port and a second port. Thus, the second gas source 500 and the waste reservoir 650 are optional in the simplified beverage system. The valve of the simplified beverage system is accordingly operable between a first orientation and a second orientation.

When the valve of the simplified beverage system is in the first orientation, the beverage flows out of the beverage container, through the beverage line, and out of the output port (e.g., nozzle). When the valve of the simplified beverage system is in the second orientation after the keg kicks, the beverage container (e.g., keg) is interrupted from flowing beverage or water between the beverage container and the nozzle via the beverage line. The clearing fluid source (e.g., water source) is connected instead, and the water can be forced through the beverage line such that it forces the remaining beverage in the beverage line out of the nozzle.

Instead of having a second gas source to force the beverage/water mixture back down the beverage line to a waste reservoir, the valve of the simplified beverage system may revert back to the first orientation. A new beverage container may replace the previous beverage container. The first gas source is configured to cause at least a portion of the volume of beverage disposed within the new beverage container to flow from the new beverage container through the beverage line toward the output port, thereby forcing the remaining beverage (from the previous beverage container) and remaining water in the beverage line to flow through the beverage line, passing the first port of the valve, and out of the output port. Once the remaining beverage (from the previous beverage container) and remaining water in the beverage line are displaced by the beverage from the new beverage container, the simplified beverage system becomes ready for another pour, now with the new beverage.

Figure 6:
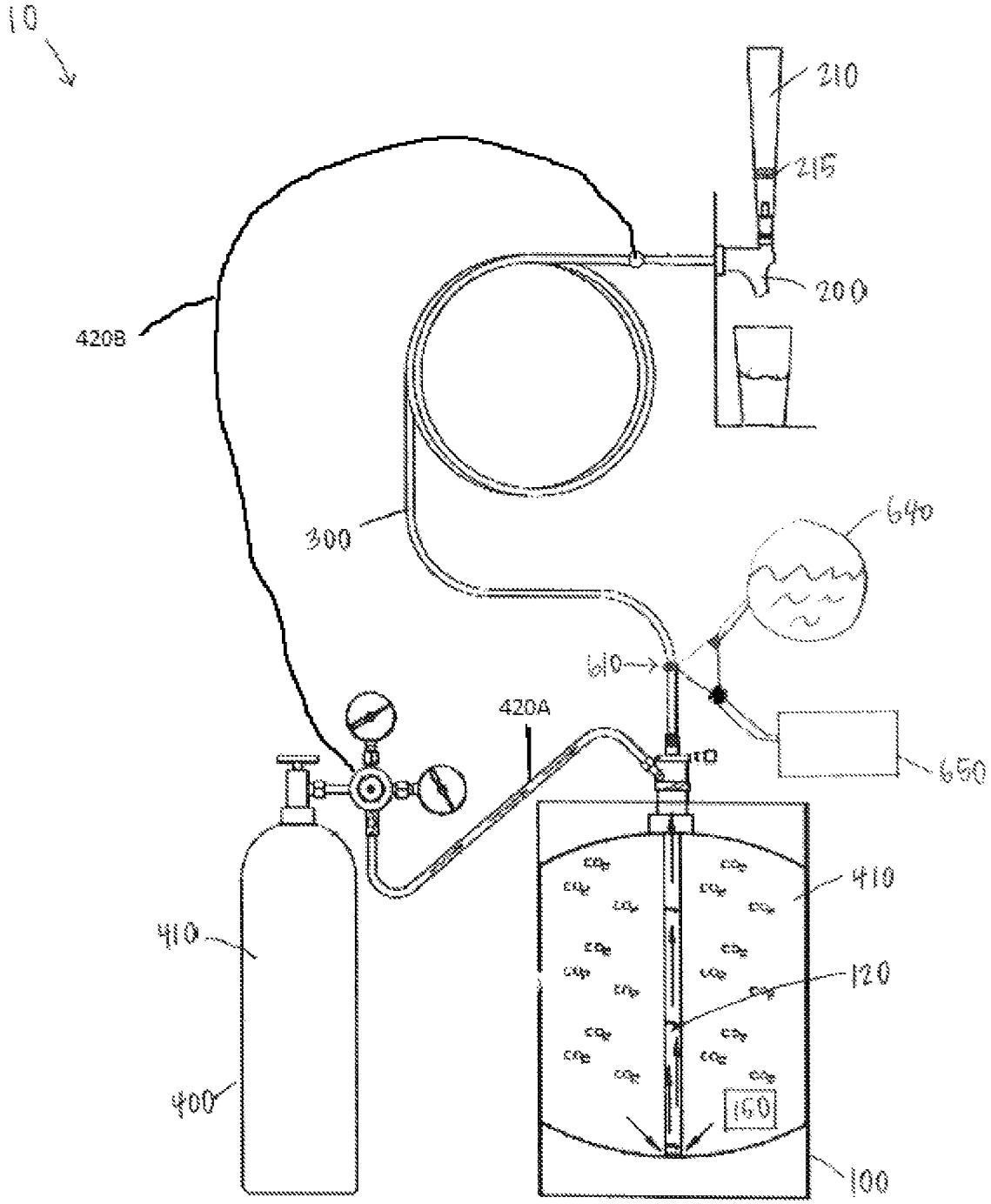
FIG. 6 illustrates a beverage transportation system having two gas lines connected to a gas source.

FIG. 6 shows an additional implementation that does not include the second gas source. FIG. 6 shows a beverage system 10 that is generally similar to the beverage system 10 illustrated in FIGS. 3-5. However, in FIG. 6, the first gas source is fluidly coupled to the beverage container 100 via a first gas tube 420A, and also fluidly coupled to the beverage line 300 near the output port 200 via a second gas tube 420B. In this implementation, gas flows from the first gas source to the beverage container 100 via the first gas tube 420A in order to push the beverage 110 through the beverage line 300 and output of the output port 200, when the valve 600 is in the first orientation. Once the beverage container 100 kicks and the gaseous substance 410 inside the first gas source 400 begins to filter through the beverage 110 that remains in the beverage line, the valve 600 transitions to the second orientation and the clearing fluid in the clearing fluid source 640 is used to empty the remaining amount of the beverage 110 from the beverage line 300 out of the output port 200. Once the remaining amount of the beverage 110 is cleared from the beverage line 300, the valve 600 transitions to the third orientation. Gas can then flow from the first gas source 400, through the second gas tube 420B. This gas enters the beverage line 300 in close proximity (e.g., within less than about five feet, less than about two and a half feet, within less than about one foot, with less than about six inches) to the output port 200. Because the output port 200 is not activated by the tap handle 210 and the valve 600 is in the third orientation, the gas flowing from the second gas tube 420 forces any remaining amount of the beverage 110 and the clearing fluid through the beverage line 300 and into the waste reservoir 650.

While the present disclosure has been described with reference to one or more particular embodiments and implementations, those skilled in the art will recognize that many changes may be made thereto without departing from the spirit and scope of the present disclosure. Each of these embodiments and implementations and obvious variations thereof is contemplated as falling within the spirit and scope of the present disclosure, which is set forth in the claims that follow.

What is claimed is:

1. A system for transporting beverage, comprising:

a container having a volume of beverage disposed therein;

an output port;

a first length of tubing having a first end and a second end, the first end of the first length of tubing being fluidly coupled to the container, the second end of the first length of tubing being fluidly coupled to the output port, the first length of tubing having a portion of the volume of the beverage disposed therein;

a first gas source fluidly coupled to the container via a second length of tubing;

a second gas source fluidly coupled to the first length of tubing; and a valve comprising a first port, a second port, and a third port, the first port of the valve being fluidly coupled to the first length of tubing, the second port of the valve being fluidly coupled to a clearing fluid source, the third port of the valve being fluidly coupled to a waste reservoir;

wherein the valve is operable between a first orientation, a second orientation, and a third orientation, the valve in the first orientation fluidly connecting the container and the output port via the first length of tubing, the valve in the second orientation fluidly connecting the clearing fluid source and the output port via the first length of tubing, the valve in the third orientation fluidly connecting the second gas source and the waste reservoir via the first length of tubing, and wherein in response to the valve moving from the first orientation to the second orientation, the clearing fluid source causes a clearing fluid to flow through the first length of tubing such that the portion of the volume of the beverage that is disposed in the first length of tubing flows through the first length of tubing and out of the output port.

2. The system of claim 1, wherein the valve is fluidly coupled to the first length of tubing adjacent to the first end of the first length of tubing.

3. The system of claim 1, wherein, in response to the valve being in the first orientation, the first gas source is configured to cause at least a portion of the volume of beverage disposed in the container to flow from the container, through the first length of tubing, and out of the output port.

4. The system of claim 1, wherein the second gas source is fluidly coupled to the first length of tubing adjacent to the second end of the first length of tubing.

5. The system of claim 1, wherein in response to the valve moving from the second orientation to the third orientation, the second gas source is configured to cause at least a volume of the clearing fluid in the first length of tubing to flow through the first length of tubing and into the waste reservoir.

6. A system for transporting beverage, comprising:

a container having a volume of beverage disposed therein;

an output port;

a first length of tubing having a first end and a second end, the first end of the first length of tubing being fluidly coupled to the container, the second end of the first length of tubing being fluidly coupled to the output port, the first length of tubing having a portion of the volume of the beverage disposed therein;

a first gas source fluidly coupled to the container via a second length of tubing;

a second gas source fluidly coupled to the first length of tubing; and a valve comprising a first port, a second port, and a third port, the first port of the valve being fluidly coupled to the first length of tubing, the second port of the valve being fluidly coupled to a clearing fluid source, the third port of the valve being fluidly coupled to a waste reservoir, wherein the valve is operable between a first orientation, a second orientation, and a third orientation, the valve in the first orientation fluidly connecting the container and the output port via the first length of tubing, the valve in the second orientation fluidly connecting the clearing fluid source and the output port via the first length of tubing, the valve in the third orientation fluidly connecting the second gas source and the waste reservoir via the first length of tubing.

7. The system of claim 6, wherein, in response to the valve being in the first orientation, the first gas source is configured to cause at least a portion of the volume of beverage disposed in the container to flow from the container, through the first length of tubing, and out of the output port.

8. The system of claim 6, wherein in response to the valve being in the second orientation, the clearing fluid source is configured to cause a clearing fluid to flow through the first length of tubing to thereby cause the portion of the volume of beverage that is disposed in the first length of tubing to flow through the first length of tubing and out of the output port.

9. The system of claim 6 wherein in response to the valve being in the third orientation, the second gas source is configured to cause a portion of the volume of beverage that is disposed in the first length of tubing to flow through the first length of tubing and into the waste reservoir.

* * * * *